United States Patent [19]

Kane

[11] 3,992,067

[45] Nov. 16, 1976

[54] CONFERENCE DESK

[76] Inventor: William C. Kane, 1541 Metropolitan Ave., Bronx, N.Y. 10462

[22] Filed: Nov. 12, 1975

[21] Appl. No.: 631,056

[52] U.S. Cl. ..... 312/194; D6/162; 312/239

[51] Int. Cl.[2] ..... A47B 47/00

[58] Field of Search ..... 312/194, 195, 239, 157; D6/161, 162 X

[56] References Cited

UNITED STATES PATENTS

| | | | |
|---|---|---|---|
| 3,181,923 | 5/1965 | Guillon et al. | 312/195 |
| 3,533,362 | 10/1970 | Thompson et al. | 312/195 |
| 3,838,902 | 10/1974 | Tenani | 312/195 |
| D134,298 | 11/1942 | Eppenstein | D6/162 |
| D142,121 | 8/1945 | Ristenpart | D6/162 |

FOREIGN PATENTS OR APPLICATIONS

| | | | |
|---|---|---|---|
| 929,683 | 6/1963 | United Kingdom | 312/195 |

*Primary Examiner*—Casmir A. Nunberg
*Attorney, Agent, or Firm*—James P. Malone

[57] ABSTRACT

A combination conference table and desk. One end of a desk top fits over and rests on a pedestal containing drawers. The other end of the table top resting on a centrally located leg. The pedestal end of the desk top has a generally rectangular shape and the other end of the table top is enlarged and has an extending curved configuration so that a plurality of persons may sit around the conference desk all in comfortable writing positions.

1 Claim, 5 Drawing Figures

CONFERENCE DESK

This invention relates to desks and more particularly to a combination conference table and desk.

In offices, such as banks and general business offices it is frequently necessary to have conferences of four or five persons where all parties have to examine plans, write notes, and/or sign papers. This is impossible with conventional desks, even large ones, since they generally have vertical sides which prevent all persons except the desk occupant from putting their knees under the table top so as to assume a comfortable writing position.

This situation generally requires a separate conference room which is unused for most of the time thereby creating unutilized space and additional expense.

The conference desk of the present invention is designed to provide features not found in the usual desk, and also, to avoid undesirable features commonly found.

Most desks are made with square, sharp corners which can give you at least a pain in the thigh. Then, if a customer or client sits at the side of the desk and wishes to face the occupant, he twists his body, bangs his knees against the pedestal and has a hard time trying to sign a paper. It is impossible for four or more people dealing with the occupant, they all are candidates for water on the knee. There is one exception, some desks provide a recessed back panel which allows knee space for the one person directly facing the occupant.

Another item that it is inconvenient, is the shallow drawer in the center of most desks. This not only prevents the occupant from crossing his knees but usually contains just a tray for paper clips and rubber bands and a large assortment of junk that you had forgotten existed.

The present invention solves these problems by providing a combination conference table and desk. The desk has a single pedestal containing several drawers, including a file drawer, and the other end of the desk top has an enlarged curved configuration with a centrally located single leg. There are no vertical sides, so that all parties can sit at the desk in comfortable writing position. A desk of approximately 8 feet × 4 feet at its widest dimensions will accommodate up to five persons for a conference.

Accordingly, a principal object of the invention is to provide a new and improved combination desk and conference table.

Another object of the invention is to provide a new and improved combination desk and conference table having a single pedestal containing drawers at one end of the desk top.

Another object of the invention is to provide a new and improved combination desk and conference table having a single pedestal containing drawers at one end of the desk top, said desk having an enlarged curved configuration at the other end from the pedestal and having a single leg centrally located under the enlarged portion so that four or five people may sit around the conference desk in comfortable writing position.

These and other objects of the invention will be apparent from the following specification and drawings of which:

Figure 1:
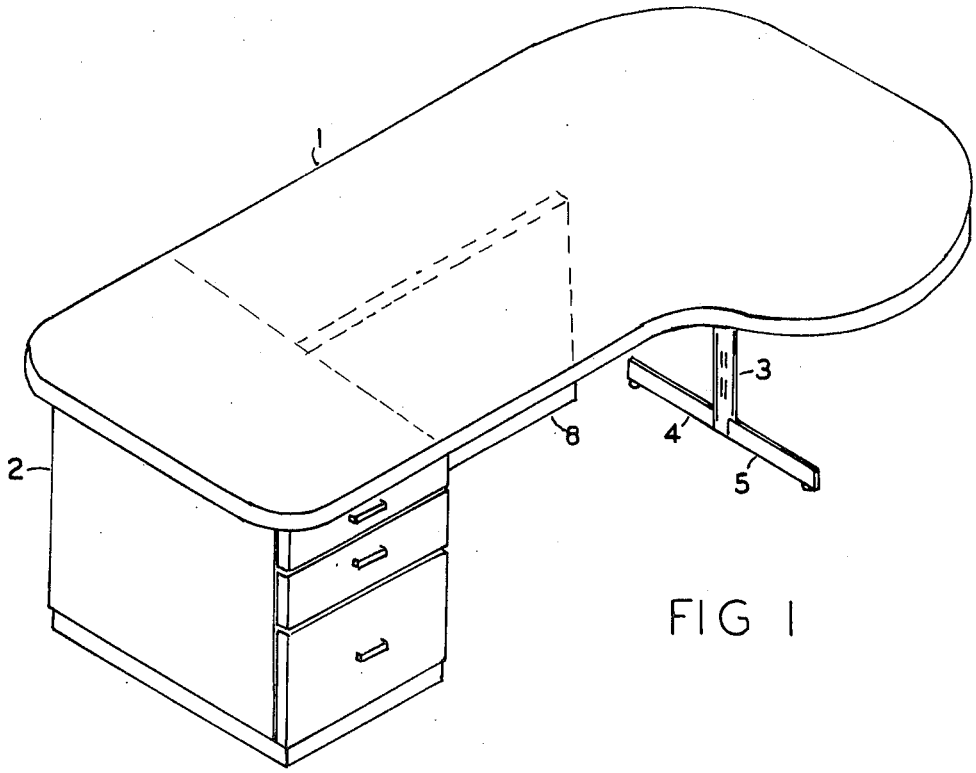
FIG. 1 is a perspective view of an embodiment of the invention.

Referring to the figures, the invention generally comprises a desk top 1, one end of which rests on a pedestal 2, containing three drawers for storing files and other material. The other end of the desk top away from the pedestal is supported by a centrally located leg 3, which preferably has extending feet 4 and 5, and extending upper portions 6 and 7, to provide a stable support for the desk top which will permit several persons to sit around the desk top in a comfortable writing position. A vertical shield 8, is preferably placed under the central portion of the desk top between the pedestal 2 and the leg 3, so as to shield the legs of the desk occupant.

Therefore, the desk occupant is in easy communication with the file and other drawers from which he or she may conveniently produce various forms or other papers to be signed by the parties to the conference. The desk top on top of the pedestal is available for carrying necessary articles for use of the desk occupant, as the visiting persons will sit around the other portion of the desk top.

Figure 2:
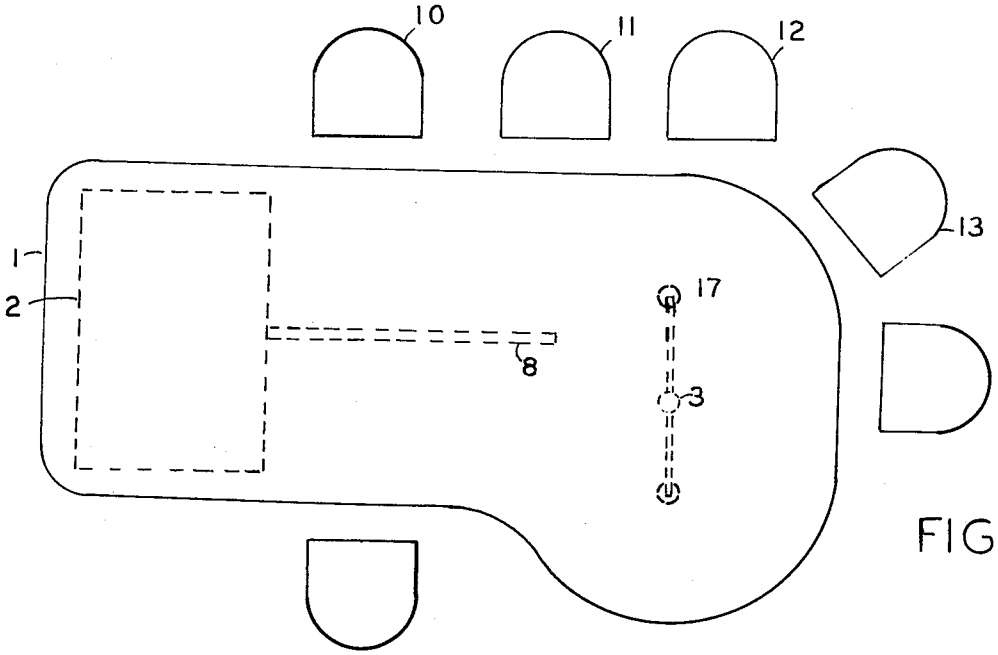
FIG. 2 is a top view showing a typical seating arrangement.

FIG. 2 is a top view showing a typical sitting arrangement whereby chairs 10, 11, 12 and 13, may be placed around the conference desk for the use of the visiting persons.

Figure 5:
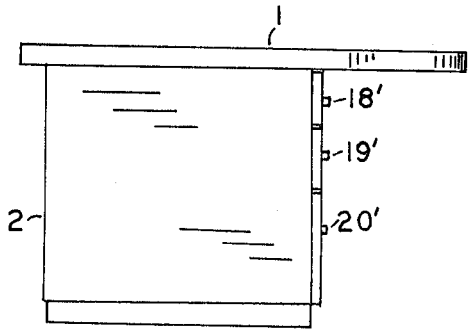
FIG. 5 is the other side view of FIG. 2.
Figure 3:
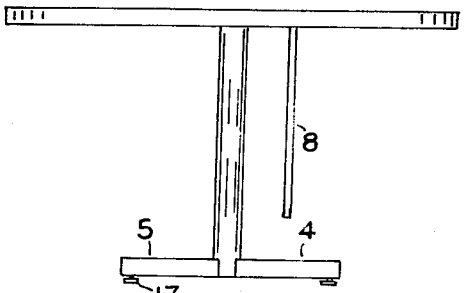
FIG. 3 is one side view of FIG. 2.
Figure 4:
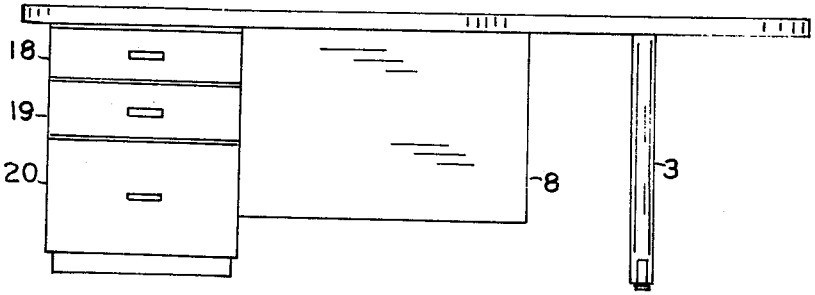
FIG. 4 is a front view of FIG. 2.

Referring to FIGS. 3, 4, and 5, they show front and side views of the conference desk showing two drawers 14 and 15, which may for instance, be six inches deep and a file drawer 16. The leg 3 preferably has levelling feet 17.

The single pedestal is preferably 1 foot - 8 inch wide rather than the usual 1 foot - 3 inch. This affords space in the two top six inch deep drawers for the convenience tray (clips etc.), sliding reference shelf, letter tray, card file tray and even space for a ladies pocketbook. The bottom twelve inch drawer provides for hanging file folders, even legal size. The modesty panel 8 shown is for the avoidance of embarrassment of a female occupant of the desk.

The other end of the desk is supported by a single leg. This leads us into the real advantages of the conference desk. The large area of this end of the desk permits the occupant to address himself to four or more people in a direct eyeball to eyeball conference fashion. All have leg room under the desk. The area of the desk is sufficient for the opening up of plans, the passing around of legal papers, the presentation of sale information, the signing of documents, etc. All this is done in a close, intimate conference format. Any files necessary for the conference are immediately available in the desk pedestal. The shape of the desk as the occupant sits at it gives him added rest area for his writing arm. The desk may be made for either right hand or left hand occupants. The drawers 18, 19 and 20 preferably have hand holds 18′, 19′ 20′.

I claim:

1. Combination conference table and desk comprising, a pedestal containing drawers, a single leg, a desk top, one end of said top fitting over and resting on said pedestal, the other end of said top resting on said leg, said one end of said top having a generally rectangular shape, said other end of said table top being enlarged and having an extending curved configuration so that a plurality of persons may sit around said table top in comfortable writing position, wherein said curved configuration extends in the same direction that the drawers extend when pulled out there being sufficient space between the extending portion and the drawers for the desk occupant to sit, said single leg being centrally located under the said end of the table top having said curved configuration, and a shield centrally mounted under the table top in front of the space for the principal desk occupant, whereby a plurality of visitors may be accommodated in comfortable writing positions with the desk owner the central figure of the conference.

* * * * *

UNITED STATES PATENT OFFICE

CERTIFICATE OF CORRECTION

Patent No. 3,992,067 Dated Nov. 16, 1976

Inventor(s) William C. Kane

It is certified that error appears in the above-identified patent and that said Letters Patent are hereby corrected as shown below:

Column 2, line 32, "14 and 15" should read -- 18 and 19 --; line 33 "16" should read -- 20 --.

Signed and Sealed this

Fifteenth Day of February 1977

[SEAL]

*Attest:*

RUTH C. MASON
*Attesting Officer*

C. MARSHALL DANN
*Commissioner of Patents and Trademarks*